US006272733B1

(12) United States Patent
Baker, Jr.

(10) Patent No.: US 6,272,733 B1
(45) Date of Patent: Aug. 14, 2001

(54) TRANSFORMER CHANGE-OUT PROCEDURE

(75) Inventor: John M. Baker, Jr., P.O. Box 42312, Las Vegas, NV (US) 89116

(73) Assignees: John M. Baker, Jr.; Fran Campa-Baker, both of Las Vegas, NV (US)

( * ) Notice: Subject to any disclaimer, the term of this patent is extended or adjusted under 35 U.S.C. 154(b) by 0 days.

(21) Appl. No.: 08/991,893

(22) Filed: Dec. 16, 1997

Related U.S. Application Data

(63) Continuation of application No. 08/420,086, filed on Apr. 11, 1995, now abandoned.

(51) Int. Cl.[7] ..... H01F 41/00
(52) U.S. Cl. ..... 29/602.1; 29/402.08
(58) Field of Search ..... 29/602.1, 402.08; 336/65

(56) References Cited

U.S. PATENT DOCUMENTS

| | | | |
|---|---|---|---|
| 2,798,969 | 7/1957 | Benton | 307/64 |
| 3,443,113 | 5/1969 | Goodman et al. | 307/17 |
| 3,488,563 | 1/1970 | Caruthers et al. | 317/157.6 |
| 4,562,360 | 12/1985 | Fujimoto | 307/149 |
| 5,081,367 | 1/1992 | Smith et al. | 307/64 |

*Primary Examiner*—Carl E. Hall
(74) *Attorney, Agent, or Firm*—Lyon & Lyon LLP

(57) ABSTRACT

An improved method and procedure of change-out of a defective power transformer. A replacement transformer is temporarily substituted for the defective transformer which is to be removed. The replacement transformer is brought to the transformer site and placed on a suitable support while the defective transformer is disconnected. The replacement transformer is temporarily electrically connected between the incoming utility lines and customer facility, and the defective transformer is removed. In the event the site has become contaminated by leaking transformer fluid or the like, the site is cleaned up. Then, the replacement transformer or another transformer, is moved to the site and connected in place of the removed defective transformer.

20 Claims, 1 Drawing Sheet

TRANSFORMER CHANGE-OUT PROCEDURE

Figure 1:
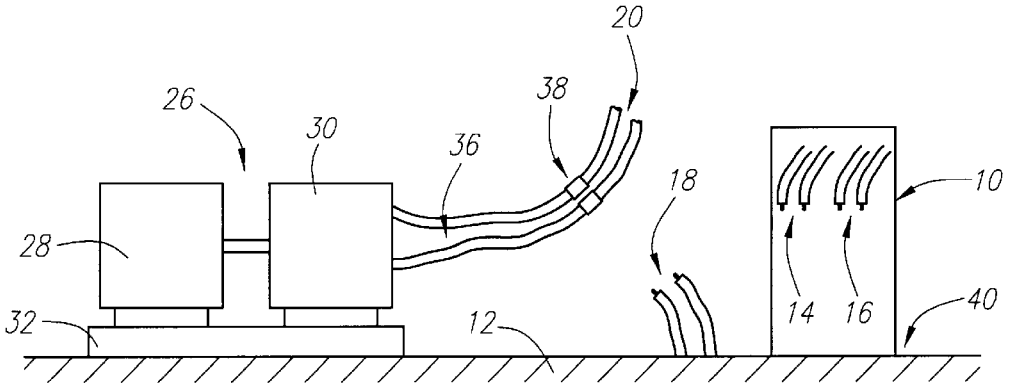

This application is a continuation of U.S. application Ser. No. 08/420,086, filed on Apr. 11, 1995, abandoned. The subject matter of the present application is also related to that of application Ser. No. 08/397,614 filed Mar. 2, 1995, now U.S. Pat. No. 5,686,696 issued Nov. 11, 1997, entitled "Transformer Pad" and assigned to the present applicant.

BACKGROUND

Utility systems, such as those serving a town or city, comprise a power grid having power lines for local distribution at a high voltage and this is in turn reduced to a lower voltage, usually 220V or 110V, for distribution to individual consumer facilities within a limited area served by a step-down utility power transformer. In many areas these transformers are located on power poles, and in others they are disposed on the ground or below ground. In a residential neighborhood, for example, one power transformer may serve several homes; whereas, in a commercial or industrial area there may be one or more transformers per business establishment.

The typical utility power transformer today comprises a case which houses the usual primary and secondary windings and conductors, and along with a transformer liquid or oil. Unfortunately, from time to time, these transformers leak because of rust or corrosion of the case, and the transformer oil flows from the transformer to the surrounding area. In those installations where the transformer is mounted on a power pole, frequently the oil leaks onto the pole or its cross members and may not significantly contaminate the ground below. On the other hand, where the transformer is disposed on the ground or below ground level, if such leaking occurs it contaminates the underlying and surrounding soil requiring clean-up of the soil.

In relatively hot areas, such as desert areas of Nevada, Arizona, and the like, the transformer leaking problem is more acute. In the Las Vegas, Nev. area for example, residential transformers usually are situated on the ground or below ground level, and when a leak occurs it is necessary to remove the transformer, clean up the underlying and surrounding soil, and then install a new transformer. This procedure involves disconnecting the electrical conductors of the faulty transformer and providing a temporary AC power source in the form of a portable motor-generator or alternator in place of the transformer while the soil is cleaned up. It is particularly necessary in hot geographical areas to do this because the residences or other buildings cannot be without cooling or air conditioning for the frequently prolonged period of soil clean-up. Needless to say, it is important to expeditiously and economically complete the change-out procedure.

Since the average power transformer change-out requires a temporary power supply typically of 67.5 KVA, the size of the portable motor-generator system and cost is a big concern. The initial cost for one such portable system is approximately $45,000, not to mention all of the other upkeep and on-going operating costs.

Accordingly, a need exists for a more efficient and economical system and method of change-out of leaking or other defective transformers.

SUMMARY OF THE PRESENT INVENTION

The present invention relates to power transformers used by utility companies, and more particularly to removal and replacement ("change-out") of the leaking transformers. Whereas the above-noted U.S. Pat. No. 5,686,696 addresses the problem of containment of the leaking oil or other fluid from the transformer, the present application provides an improved form of change-out procedure.

According to the concepts of the present invention, the use of a portable motor-generator or alternator is dispensed with and, in its place another, operative transformer is used instead. The transformer may be a new replacement power transformer or any other suitable operative transformer of appropriate size. Basically, the replacement transformer is temporarily substituted for the leaking transformer being removed. The replacement transformer is brought to the transformer site, and placed on a stand or other suitable support. The primary and secondary cables of the leaking transformer are disconnected, and temporary connecting cables are provided from the replacement transformer to the consumer facility and incoming power lines. The leaking transformer is then removed, and clean-up of the site completed. The replacement transformer (or another transformer) is then moved to the site and connected in place of the removed leaking transformer.

Accordingly, it is a principal object of the present invention to provide an improved power transformer change-out method.

Another object of the present invention is to facilitate replacement of a leaking or otherwise defective power transformer in a more economical manner by temporarily electrically substituting a replacement transformer for the transformer to be removed during removal thereof and clean-up of the old transformer site, and then substituting the replacement transformer, or another transformer, for the leaking or defective transformer which has been removed.

Figure 2:
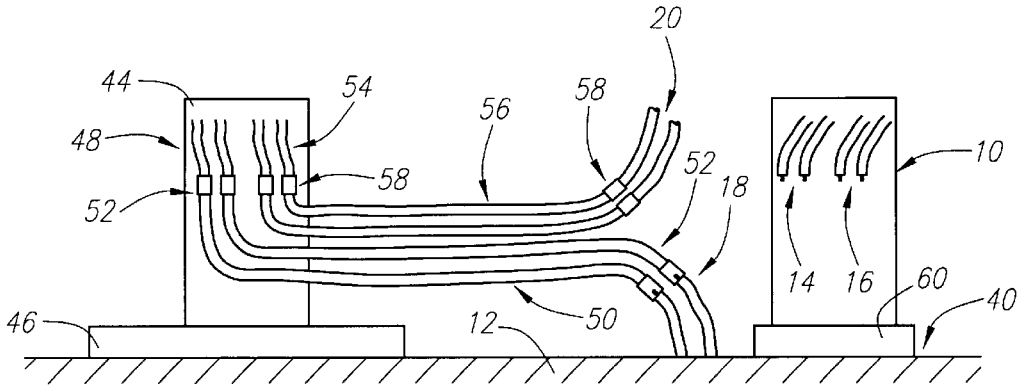

These and other objects and advantages of the present invention will become better understood through a consideration of the following description, taken in conjunction with the drawing in which:

FIG. 1 is a diagrammatic view of equipment used in the current, prior art, power transformer change-out procedure; and FIG. 2 is a diagram illustrating equipment used in the change-out procedure of the present invention.

DETAILED DESCRIPTION

Turning now to the drawing, FIG. 1 is a diagrammatic illustration of the equipment involved in the current prior art-type change-out procedure. It illustrates a power transformer 10 which is leaking oil or other transformer fluid, or otherwise is defective, that needs to be replaced. Transformer 10 is disposed on or in the ground 12 in a typical installation in desert areas such as Las Vegas, Nev. The transformer 10 has the usual primary 14 and secondary 16 cables extending therefrom. In an underground utility power system of the type illustrated in FIG. 1, the power lines as illustrated at 18 from the power utility are provided to the site for underground conduits (not shown). Service lines 20 supply power to the customer facility, e.g., a residence or business establishment.

In the existing power transformer change-out procedure, a portable motor-generator or alternator set 26 comprising a gasoline or diesel engine 28 and AC alternator or generator 30 on a skid 32 is brought to the site. Then, the power utility cables 18 are disconnected from the primary cables 14 of the transformer 10, and the secondary cables of the transformer 10 are disconnected from the service cables 20 to the facility. Temporary power cables 36 are then connected by electrical connections 38 to the facility service cables 20 to thereby supply temporary power (e.g., 110 V AC) to the facility during the time the defective transformer 10 is removed and the surrounding ground or soil area 40 is cleaned up of all transformer fluid.

After the site has been cleaned up, a new or replacement transformer (not shown) is brought to the site (or brought earlier) and the power cables 36 from the motor-generator 26 are disconnected. The replacement transformer is then installed in place of the transformer 10, and the respective cables 14–18 and 16–20 are connected to thereby again supply power to the building via the replacement transformer. The motor-generator 26 then is removed to the next change-out site or returned to a storage yard. It will be appreciated that this current change-out procedure not only involves the cost, transportation, connection and disconnection of the motor-generator set 26, but also the attendant required fuel supply, exhaust pollution, noise and other problems.

According to the concepts of the present invention, this prior procedure is substantially simplified and is more economical and efficient. No motor-generator set 26 is used. Instead, a new or replacement transformer 44 is brought to the site as illustrated in FIG. 2 and placed on a suitable block, stand or the like 46 to provide a temporary source of AC power to the facility. The transformer 44 alternatively can be mounted on a trailer (also represented by 46) and suitably towed to the site.

The primary and secondary cables 14–16 of the leaking transformer 10 are disconnected from the utility and facility service cables 18 and 20 in the same manner as discussed above. The utility cables 18 are connected to the primary cables 48 via temporary connecting cables 50 and electrical connections 52, and the secondary cables 54 of the replacement transformer 44 are connected through temporary cables 56 and electrical connections 58 to the facility service cables 20. The defective transformer 10 then is hoisted and removed for disposal or repair, followed by clean-up of the soil 40 which typically takes at least several hours.

After clean-up of the site 40, the new or replacement transformer 44 is disconnected from its temporary cables 50 and 56, moved into position at the site 40 in place of the removed old transformer 10 and then connected to the utility 18 and facility service 20 cables.

Preferably, the replacement transformer 44 is placed on a transformer pad 60 or like containment device of the nature described in the above-identified U.S. Pat. No. 5,686,696. The pad 60 can be in the form of a container such that if the replacement transformer 44 ultimately leaks later, any leaking fluid can be collected in the pad 60 and not spill onto the surrounding area 40. After the replacement transformer 44 is connected to the utility cables 18 and facility service cables 20, its temporary support 46 is removed.

It will be appreciated that this procedure is simpler and more economical than that discussed in connection with prior art FIG. 1. Although the connecting cables 50 and 56 have been referred to as temporary cables which normally will be used because the replacement transformer 44 will be temporarily disposed at least several feet away (e.g., 6–12 feet) from the final transformer site 40, these cables 50 and 56 can serve as permanent connecting cables if desired once the replacement transformer 44 is put in place of the defective transformer 10.

While embodiments of the present invention have been shown and described, various modifications may be made without departing from the scope of the present invention, and all such modifications and equivalents are intended to be covered.

What is claimed is:

1. A method of changing out a first power transformer which has leaked transformer fluid at a site wherein utility power is carried by utility lines and supplied to the primary cables of the first transformer, and the secondary cables of the first transformer are connected to service lines of a facility, the utility lines carrying a high voltage, the method comprising the steps of:

transporting a second transformer to the site;

disconnecting the primary and secondary cables of the first transformer from the utility and service lines respectively, thereby cutting power to the facility from the first transformer;

connecting the second transformer between the utility and service lines to provide power to the facility, the second transformer being located at least several feet away from where the first transformer leaked fluid;

removing the first transformer from the site;

removing transformer fluid from the ground area at the site; and installing the second transformer at the location where the first transformer was removed from, whereby the utility line and second transformer supply power to the facility during removal of the first transformer from the site and removal of transformer fluid from the ground area at the site.

2. The method as in claim 1 wherein the second transformer is installed on a transformer pad for containment of fluid that might subsequently leak from the second transformer.

3. The method as in claim 1 wherein the step of connecting the second transformer between the utility and service lines further comprises the steps of using a first set of temporary cables to connect the primary of the second transformer to the utility lines, and using a second set of temporary cables to connect the secondary of the second transformer to the service lines, wherein the first set of temporary cables carries electrical energy exceeding a potential of 220V after being connected to the primary of the second transformer and to the utility line.

4. The method as in claim 3 wherein the step of installing the second transformer further comprises the steps of disconnecting the first and second sets of temporary cables, connecting the utility lines to the primary of the second transformer without using the first set of temporary cables, and connecting the secondary of the second transformer to the service lines without using the second set of temporary cables.

5. The method as in claim 2 wherein the step of connecting the second transformer between the utility and service lines further comprises the steps of using a first set of temporary cables to connect the primary of the second transformer to the utility lines, and using a second set of temporary cables to connect the secondary of the second transformer to the service lines whereby the utility line and second transformer supply power to the facility during removal of the first transformer from the site and removal of transformer fluid from the ground area at the site.

6. The method as in claim 5 wherein the step of installing the second transformer further comprising the steps of disconnecting the first and second sets of temporary cables, connecting the utility lines to the primary of the second transformer without using the first set of temporary cables, and connecting the secondary of the second transformer to the service lines without using the second set of temporary cables.

7. A method of changing out a first power transformer which has leaked transformer fluid at a site wherein utility power is carried by utility lines and supplied to the primary of the first transformer and the secondary of the first transformer is connected to service lines of a facility, the utility lines carrying a high voltage, said method being performed without the use of a motor-generator to supply temporary power to the facility, comprising the steps of:

transporting a second transformer to the site;

disconnecting the primary and secondary cables of the first transformer from the utility and service lines respectively, thereby cutting power to the facility from the first transformer;

connecting the second transformer between the utility and service lines to provide power to the facility, the second transformer being located at least several feet away from where the first transformer leaked fluid;

removing the first transformer from the site;

removing transformer fluid from the ground area at the site, and installing the second transformer at the location where the first transformer was removed from whereby the energized utility line and second transformer supply power to the facility during removal of the first transformer from the site and removal of transformer fluid from the ground area at the site.

8. The method as in claim 7 wherein the second transformer is installed on a transformer pad for containment of fluid that might subsequently leak from the second transformer.

9. The method as in claim 7 wherein the step of connecting the second transformer between the utility and service lines further comprises the steps of using a first set of temporary cables to connect the primary of the second transformer to the utility lines, and using a second set of temporary cables to connect the secondary of the second transformer to the service lines whereby the energized utility line and second transformer supply power to the facility during removal of the first transformer from the site and removal of transformer fluid from the ground area at the site.

10. The method as in claim 9 wherein the step of installing the second transformer further comprises the steps of disconnecting the first and second sets of temporary cables, connecting the utility lines to the primary of the second transformer without using the first set of temporary cables, and connecting the secondary of the second transformer to the service lines without using the second set of temporary cables.

11. The method as in claim 8 wherein the step of connecting the second transformer between the utility and service lines further comprises the steps of using a first set of temporary cables to connect the primary of the second transformer to the utility lines, and using a second set of temporary cables to connect the secondary of the second transformer to the service lines, wherein the first set of temporary cables carries electrical energy exceeding a potential of 220V after being connected to the primary of the second transformer and to the utility line.

12. The method as in claim 11 wherein the steps of installing the second transformer further comprises the steps of disconnecting the first and second sets of temporary cables, connecting the utility lines to the primary of the second transformer without using the first set of temporary cables, and connecting the secondary of the second transformer to the service lines without using the second set of temporary cables.

13. A method of changing out a first power transformer which has leaked transformer fluid at a site wherein utility power is carried by utility lines and supplied to the primary of the first transformer and the secondary of the first transformer is connected to service lines of a facility, the utility lines carrying a high voltage, the method comprising the steps of:

transporting a second transformer to the site;

transporting a third transformer to the site;

disconnecting the primary and secondary cables of the first transformer from the utility and service lines respectively, thereby cutting power to the facility from the first transformer;

connecting the second transformer between the utility and service lines to provide temporary power to the facility;

removing the first transformer from the site;

removing transformer fluid from the ground area at the site;

disconnecting the second transformer from the utility and service lines, thereby cutting power to the facility from the second transformer; and installing the third transformer at the location where the first transformer was removed from whereby the energized utility line and second transformer supply power to the facility during removal of the first transformer from the site and removal of transformer fluid from the ground area at the site.

14. The method as in claim 13 wherein the third transformer is installed on a transformer pad for containment of fluid that might subsequently leak from the third transformer.

15. The method as in claim 13 wherein said method is performed without the use of a motor-generator to supply power to the facility.

16. The method as in claim 14 wherein said method is performed without the use of a motor-generator to supply power to the facility.

17. The method as in claim 15 wherein the step of connecting the second transformer between the utility and service lines further comprises the step of placing the second transformer at a location at least several feet away from where the first transformer leaked fluid.

18. The method as in claim 16 wherein the step of connecting the second transformer between the utility and service lines further comprises the step of placing the second transformer at a location at least several feet away from where the first transformer leaked fluid.

19. The method of claim 13, wherein the utility line transmits electrical energy exceeding a potential of 220V.

20. The method of claim 13, wherein the utility is electrically connected to the facility during removal of the first transformer from the site.

* * * * *